US010859270B2

(12) United States Patent
Imfeld et al.

(10) Patent No.: US 10,859,270 B2
(45) Date of Patent: Dec. 8, 2020

(54) BURNER ASSEMBLY FOR A BURNER OF A GAS TURBINE

(71) Applicant: General Electric Technology GmbH, Baden (CH)

(72) Inventors: Jost Imfeld, Baden (CH); Alen Markovic, Karlovac (HR); Igor Bizic, Birr (CH); Vedran Druzak, Karlovac (HR); Giancarlo Ruggieri, Baden (CH); Jeffrey Alan De Jonge, Birr (CH)

(73) Assignee: General Electric Technology GmbH, Baden (CH)

( * ) Notice: Subject to any disclaimer, the term of this patent is extended or adjusted under 35 U.S.C. 154(b) by 365 days.

(21) Appl. No.: 15/710,093

(22) Filed: Sep. 20, 2017

(65) Prior Publication Data

US 2018/0080653 A1 Mar. 22, 2018

(30) Foreign Application Priority Data

Sep. 20, 2016 (EP) ..... 16189669

(51) Int. Cl.

| | |
|---|---|
| ***F23R 3/28*** | (2006.01) |
| ***F23R 3/34*** | (2006.01) |
| ***F23R 3/60*** | (2006.01) |
| ***F23C 5/02*** | (2006.01) |

(52) U.S. Cl.

CPC ..... *F23R 3/283* (2013.01); *F23C 5/02* (2013.01); *F23R 3/346* (2013.01); *F23R 3/60* (2013.01); *F23C 2900/07021* (2013.01); *F23D 2201/30* (2013.01); *F23R 2900/00005* (2013.01); *F23R 2900/00017* (2013.01); *F23R 2900/03341* (2013.01)

(58) Field of Classification Search

CPC .. F23R 3/60; F23R 3/283; F23R 3/346; F23R 2900/00005; F23R 2900/00017; F23R 2900/03341; F23R 2900/07021; F23C 5/02; F23D 2201/30

See application file for complete search history.

(56) References Cited

U.S. PATENT DOCUMENTS

| | | | |
|---|---|---|---|
| 2,523,585 | A | 9/1950 | Mueller et al. |
| 3,267,519 | A | 8/1966 | Albert |
| 3,273,343 | A | 9/1966 | Cretella |
| 4,466,240 | A | 8/1984 | Miller |

(Continued)

FOREIGN PATENT DOCUMENTS

EP 0 620 362 A1 10/1994

OTHER PUBLICATIONS

Extended European Search Report and Opinion issued in connection with corresponding EP Application No. 16189669.1 dated Mar. 15, 2017.

*Primary Examiner* — Todd E Manahan
*Assistant Examiner* — David P. Olynick
(74) *Attorney, Agent, or Firm* — Armstrong Teasdale LLP

(57) ABSTRACT

A burner assembly of a gas turbine comprising: a tubular body defining the flow path for the hot gas of the combustion during the turbine operation; an aperture for a fuel lance; a wearing ring of a sacrificial material configured to correspond to the edge of the aperture; a contacting leg extending from the wearing ring on the tubular body; a pre-tension system configured to contact the contacting leg in order to provide a pre-tension force on the ring.

12 Claims, 5 Drawing Sheets

(56) References Cited

U.S. PATENT DOCUMENTS

| | | | | |
|---|---|---|---|---|
| 4,512,712 | A | 4/1985 | Baran, Jr. | |
| 4,712,370 | A * | 12/1987 | MacGee | F01D 21/003 277/345 |
| 5,267,832 | A | 12/1993 | Johnson et al. | |
| 5,419,114 | A | 5/1995 | Bauermeister et al. | |
| 5,492,446 | A | 2/1996 | Hawkins et al. | |
| 7,757,494 | B2 * | 7/2010 | Duverneuil | F01D 25/28 60/739 |
| 7,937,950 | B2 | 5/2011 | Benz et al. | |
| 9,076,560 | B2 | 7/2015 | Mori et al. | |
| 9,321,310 | B2 | 4/2016 | Malik et al. | |
| 2007/0128002 | A1 * | 6/2007 | Geary | F01D 11/005 411/511 |
| 2007/0227157 | A1 * | 10/2007 | Benz | F23R 3/283 60/796 |
| 2013/0129501 | A1 | 5/2013 | Scothern | |
| 2016/0161125 | A1 * | 6/2016 | Benz | F23R 3/286 60/737 |

* cited by examiner

State of the Art

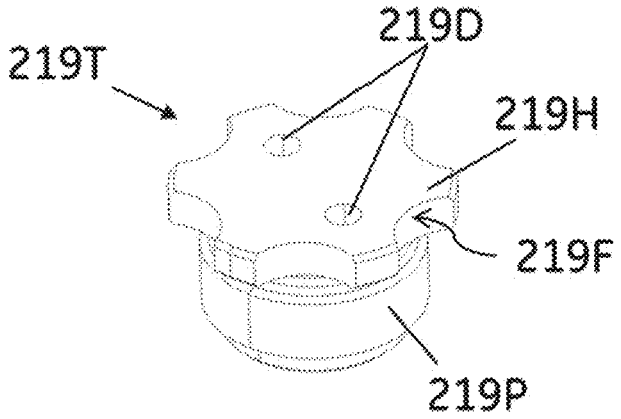
Fig.9
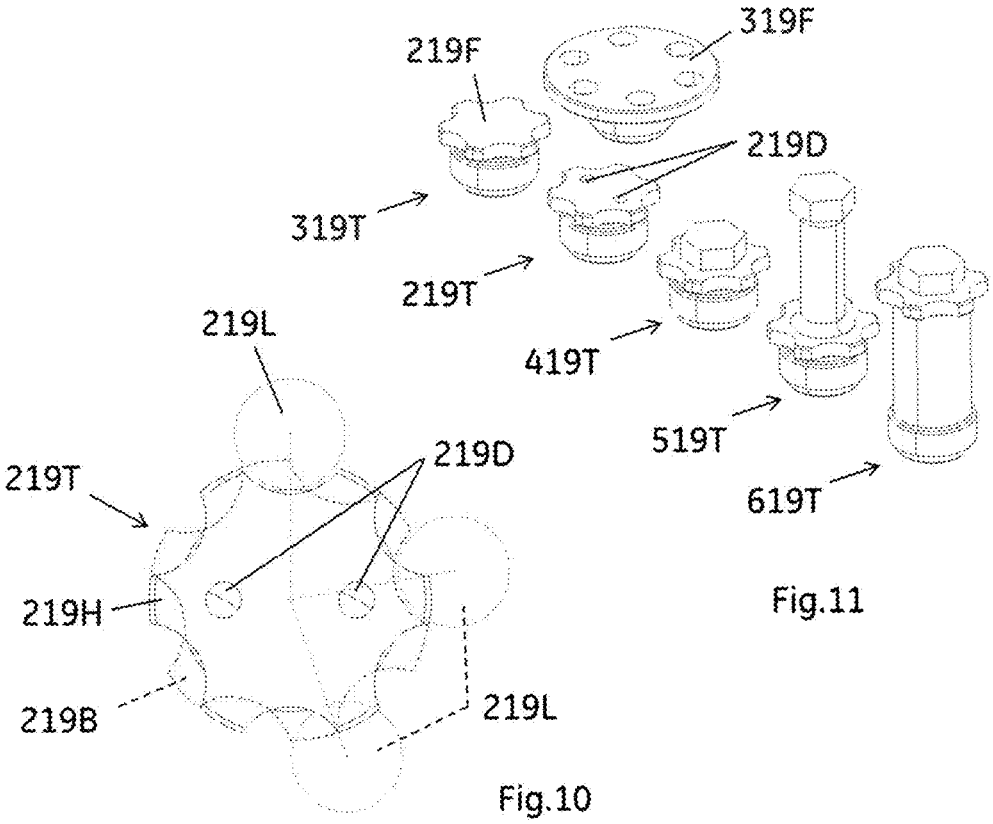
Fig.11
Fig.10

BURNER ASSEMBLY FOR A BURNER OF A GAS TURBINE

FIELD OF INVENTION

The present invention generally relates to the field of combustion technology of gas turbines.

BACKGROUND OF THE INVENTION

It is well known that in a sequential combustion gas turbine (1), described for example in EP0620362 and shown in FIG. 1, a first fuel/air mixture is burned in a EV (Environmental) combustion chamber (3) by an EV burner (5) and then expands in a high pressure turbine (7), see FIG. 1. Thereafter, the partly expanded hot mixture from the first turbine (7) is fed in a SEV (Sequential Environmental) burner (8); then, it is burnt in a SEV combustion chamber (10) and finally expands through a second low pressure turbine (11).

A fuel lance (13) is provided directly in the hot gas path flowing in the SEV burner (8) for the fuel enrichment of the partly expanded hot gases entering in this burner (8).

An EV lance, not shown in the FIG. 1, may be present in the EV burner (5), depending on the type of combustion.

Typically, both the EV and SEV combustion chambers (3; 10) have an annular arrangement fitted with a plurality of respective EV and SEV burners.

The sequential combustion is able increase the efficiency of the gas turbine process cycle without raising the turbine inlet temperature.

Furthermore, the exhaust temperature after the second low-pressure turbine can be maintained at up to 600°-700° C. over a wide part-load operating range with ideal conditions for the subsequent water steam cycle.

It is well known that the SEV fuel lance (13) needs to be mounted on the SEV burner (8) with some millimetres of clearance (usually about tenth of millimetres) for assembly purpose. Thus, vibrations may occur during the working phase of the turbine creating wearing and increasing cold air leakages between the burner and the lance, strongly impacting the operation and the emissions of the engine.

Furthermore, these leakages can be increased by creep deformation or deformations due to temperature differences between the burner and the lance during the working phase.

A disadvantage is that the leakages can locally decrease the working temperature in the SEV burner by as much as 100° C., making it very difficult an accurately control combustion parameters using a typical set up of the control system.

Another disadvantage is that the leakages can decrease the combustion temperature, detrimentally impacting the CO or the NOx emission of the turbine.

Typically, the above mentioned disadvantages are common also for other types of gas turbine different from the sequential combustion gas turbine.

Therefore, there is the need to further optimize the burner to better control the combustion operation and the emissions of a gas turbine in order to meet the environmental regulations and extend the service operational intervals.

One of the standard approaches is to make the outer surface of the Fuel lance by an alloy with less hardness than the SEV burner for reconditioning purpose and/or adding a hardface coating on the lance; these approaches are expensive and time consuming for repair.

U.S. Pat. No. 7,937,950 describes a fastening structure of rail-like design for fastening a fuel lance in an SEV burner of a sequential combustion gas turbine.

This solution is not particularly efficient because leakages may happen due to the fact that the collar can lift from its position and because possible wear between the carrier plate and the collar due to sliding forces can occur.

Another disadvantage is that a plurality of different components with accurate tolerances are needed, increasing the production costs and decreasing the structural rigidity of the fastening structure.

SUMMARY OF THE INVENTION

It is an aspect of the present invention to solve the aforementioned technical problems by providing a burner assembly for a gas turbine as substantially defined in independent claim 1.

It is another aspect of the present invention to provide a wearing ring comprising a contacting leg in which the wearing ring, of a sacrificial material, is configured to correspond to the edge of the aperture. Additionally, the contacting leg extends from the wearing ring along the tubular body; a pre-tension system configured to contact the contacting leg to provide a pre-tension force on the ring against the tubular body.

It is another aspect to provide a gas turbine comprising the wearing comprising the contacting leg.

It is a further aspect to provide a method for installing a fuel lance in a burner assembly comprising providing a pre-tension block having a pre-tension surface arranged to contact the at least one contacting leg in such a way to form a gap with the tubular body.

According to an aspect of the invention, a burner assembly of a gas turbine comprises: a tubular body defining the flow path for the hot gas of the combustion during the turbine operation; an aperture for a fuel lance having an edge (4E); a wearing ring, of a sacrificial material, configured to correspond to the edge of the aperture; a contacting leg extending from the wearing ring along the tubular body; a pre-tension system configured to contact the contacting leg in order to provide a pre-tension force on the ring against the tubular body.

The sacrificial material of the ring is a material softer than the material of the surrounding components.

For example, the sacrificial material of the ring may be a material softer than the material of the fuel lance.

In an aspect, the ring is made in a single piece.

The pre-tension force of embodiments of the present invention is able to avoid sliding, hammering and other types of wear, decreasing the vibrations and the leakages between the wearing ring and the tubular body of the burner assembly during the turbine operation; the overall robustness of the burner assembly is also improved.

The temperature in the burner is stably maintained to reduce leakages, thus enabling accurate control of the CO and NOx emissions and of the other combustion parameters.

Leakages due to creep or temperature deformations between the wearing ring and the fuel lance can be further decreased selecting a proper material for the wearing ring, thus increasing the service intervals and decreasing the servicing costs.

Additionally, when deformations happen on the ring, the ring can be easily and quickly replaced without the need of replacing the lance, decreasing the cost and the time for service operations.

The thermal loading of the wearing ring during the turbine operation increases the pre-tension force, which is beneficial in reducing vibration and wear.

Furthermore, in cold assembly state, the pre-tension force can be applied to overcome any possible load condition and creep of the lance or of the burner.

It is possible to choose the material of the burner independently by the material of the wearing ring or by the material of the Fuel lance.

The pre-tension system comprises a pre-tension block with a pre-tension surface arranged to contact the contacting leg in order to provide the pre-tension force.

The manufacturing tolerances between this pre-tension surface and the burner provide said pre-tension force on the leg.

No additional components are required, thus providing a high robustness of the burner assembly with low cost and low time for servicing.

The pre-tension system comprises a pre-tension component configured to contact the leg to provide the pre-tension force.

This pre-tension component can be easily replaced for service purpose, without the need to replace any other component.

The pre-tension component is a pre-tension bolt screwed into the pre-tension system. A locking element is also mounted into the pre-tension system and the pre-tension bolt comprises a shaped head able to engage with this locking element; the locking element is a bolt, a pin or a similar component.

In this way, the pre-tension bolt changes its relative position in respect to the locking element with counter-hole by turning, in order to allow a precise adjustment of the pre-tension force.

It is possible to avoid rotations of the bolt due to the temperature dilatations, maintaining a stable pre-tension force.

A re-adjustment of the pre-tension can be provided quickly and easily without replacing any component, decreasing the service costs.

In one embodiment, the burner assembly comprises two contacting legs extending from the ring in opposite directions and substantially parallel to the hot gas flow path; in this case, a pre-tension system is associated to each leg, as explained more in detail below.

A ring with two opposite contacting legs may allow the use of the existing elements already present on a standard burner.

However, it is not to be excluded to provide different numbers or different shape or directions of these contacting legs with an associated pre-tension system, even if the described solution appears to be the most cost effective and efficient one.

According to another aspect, a wearing ring is configured to correspond to the edge of an aperture of a burner assembly for a fuel lance; this ring being an embodiment made of a sacrificial material and comprising at least one contacting leg extending from the ring.

According to a further aspect, a gas turbine comprises a burner assembly as described above.

According to a further aspect, a method for installing a fuel lance in a burner assembly, is described below.

BRIEF DESCRIPTION OF THE DRAWINGS

The aspects and other features of the present invention will become more apparent upon reading of the following non-restrictive description of embodiments thereof, given for the purpose of exemplification only, with reference to the accompany drawings, through which similar reference numerals are used to refer to similar elements, and in which:

FIG. 9 shows a pre-tension bolt according the embodiment of FIG. 6;

FIG. 10 shows possible positions of the pre-tension bolt according the embodiment of FIG. 6;

FIG. 11 shows different embodiments of the pre-tension bolt.

Exemplary embodiments will be now described with reference to the aforementioned drawings.

DETAILED DESCRIPTION OF THE INVENTION

Figure 1:
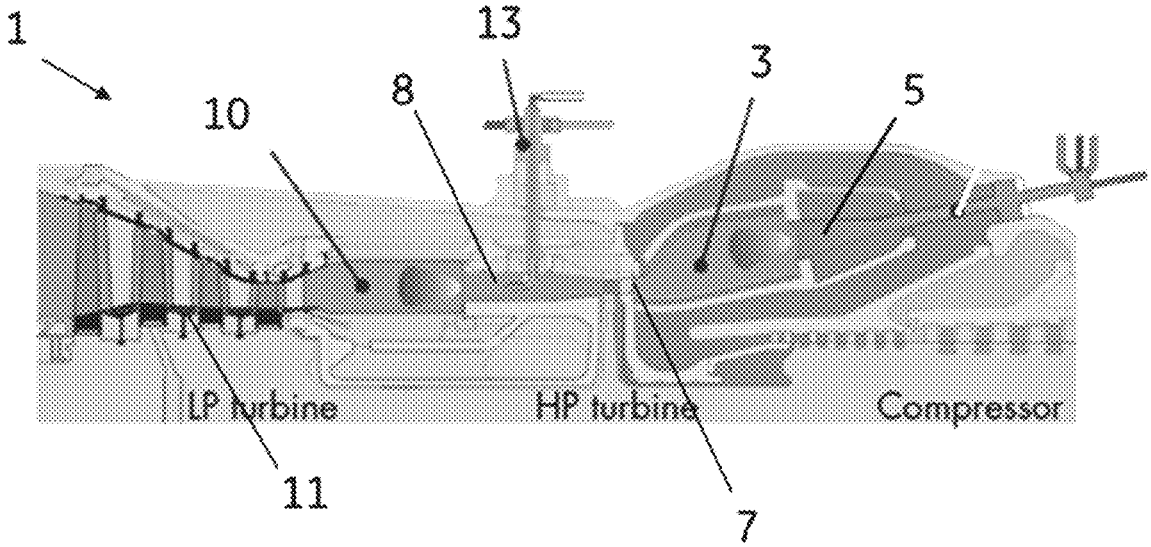
FIG. 1 shows a sequential combustion gas turbine of the prior art.
Figure 2:
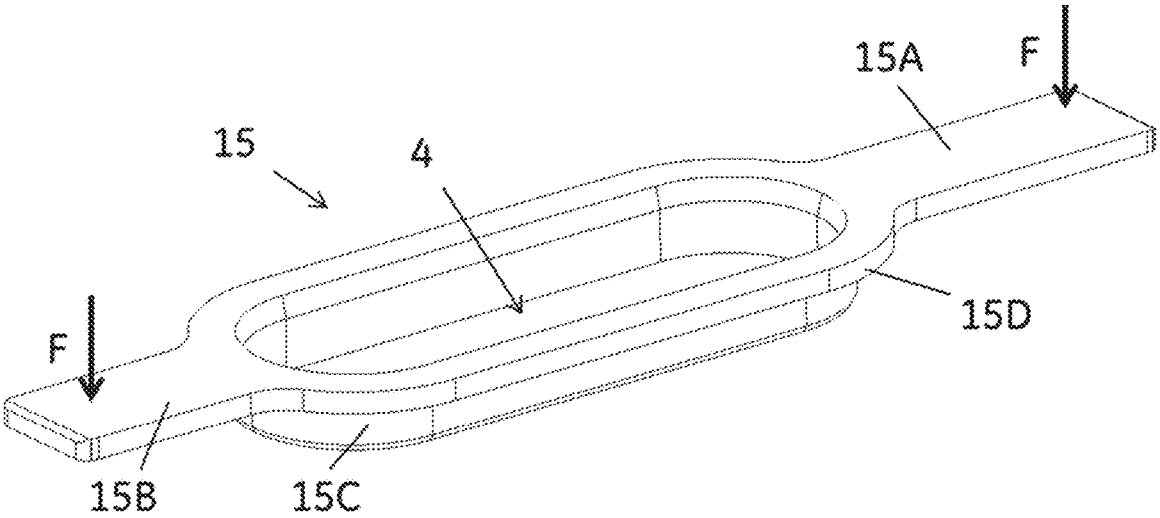
FIG. 2 shows a wearing ring according an embodiment of the present disclosure.

FIG. 2 shows a wearing ring (15) according to the present embodiments.

The wearing ring (15) comprises two contacting legs (15A, 15B) extending in opposite directions protruding from a circular section (15C).

The circular section (15C) has a protruded rim (15D) and its geometry is configured to come into contact with the edge (4E) of an aperture (4) of a burner (9), see FIGS. 3 to 6.

The ring (15) is made an embodiment by a sacrificial alloy, such as a nickel-based alloy, such as HAYNES188.

A sacrificial alloy can be an alloy softer than the material of the surrounding components.

For example, the sacrificial alloy of the ring is softer than the alloy of the fuel lance, if the lance is made with alloy.

The legs (15A, 15B) can vary in number and position and are here represented only as one solution.

Figure 3:
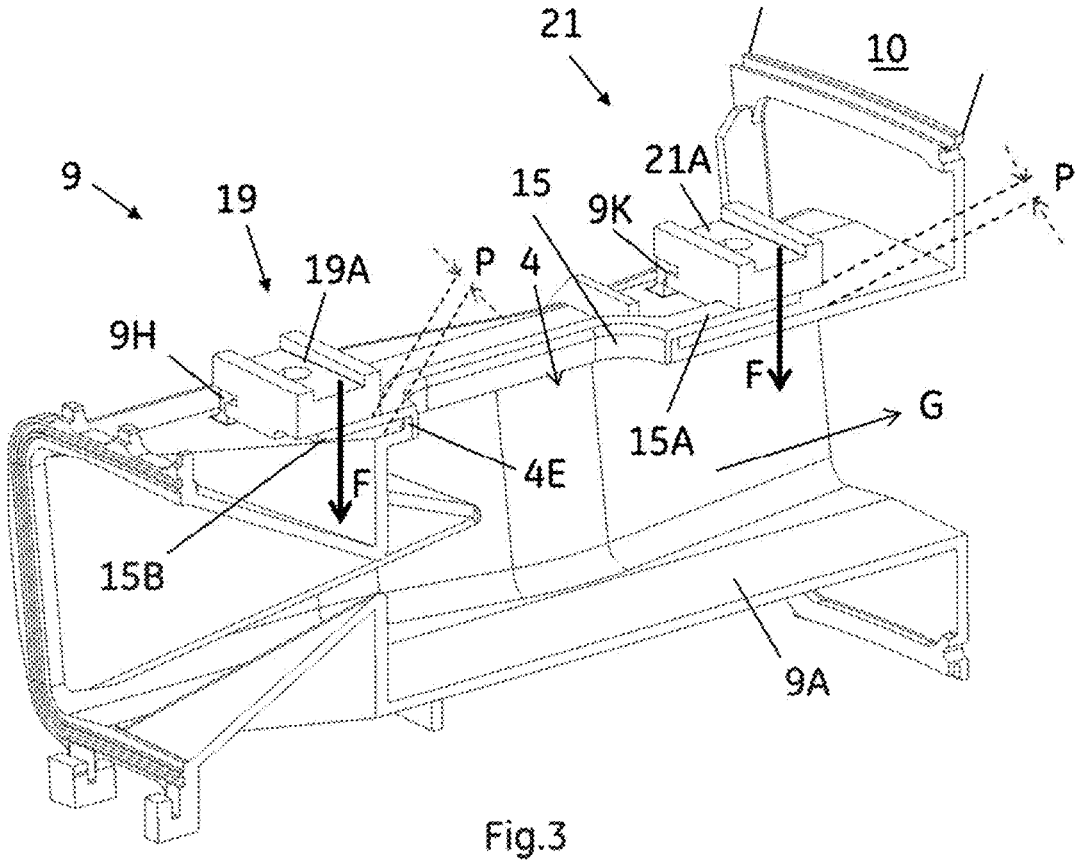
FIG. 3 shows a burner assembly according a first embodiment of the disclosure.

FIG. 3 shows a burner assembly (9) comprising a tubular body (9A) defining the hot gas flow path (arrow G) in substantial axial direction.

The hot gas flow (G) enters the burner assembly (9) from the high pressure turbine (not shown) and exits from the burner assembly (9) entering in the combustion chamber (10).

The assembly (9) also comprises an aperture (4) inside which a fuel lance (not shown) can be placed. The assembly further comprises a pair of pre-tension systems (19; 21).

In an embodiment, each pre-tension system (19; 21) comprises a pre-tension block (19A; 21A) anchored on the tubular body (9A) in such a way as to form a gap (P) with the body (9A) itself.

Different anchoring means (9H; 9K) can be provided to associate the block (19A; 21A) to the tubular body (9A), for example bolts, pins or shaped fastenings.

These blocks (19A; 21A) are already included in the design of a standard burner; however, it is not to be excluded to provide blocks with different geometry or position according specific needs.

The circular section (15C) of the ring (15) is associated and corresponds to the aperture (4); its legs (15A, 15B) extending inside the respective gap (P) in a substantially parallel direction in respect to the hot gas flow path (G).

In another embodiment of the invention, the pre-tension block (19A; 21A) comprises a shim or a pills to contact the leg (15A, 15B).

Figure 4:
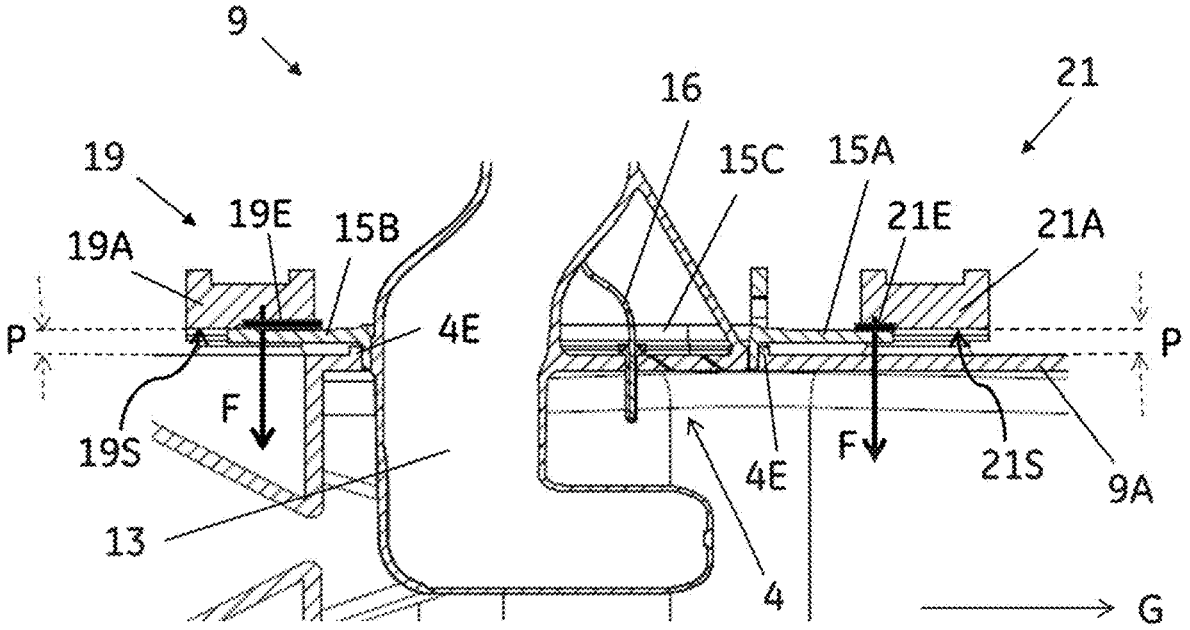
FIG. 4 shows a vertical cross-section of FIG. 3 with a Fuel lance and a sensor.

FIG. 4 shows a vertical cross-section of one of the blocks (19) of FIG. 3.

FIG. 4 also shows a fuel lance (13) placed in the aperture (4) that is aligned with the hot gas flow path (G). A sensor (16) is place in proximity to the lance (13) to monitor the combustion conditions.

In an embodiment the sensor (16) is a thermocouple used to control the operation of the combustion of the engine.

The ring (15) is place on the aperture (4) so that its circular section (15C) comes into contact with a protruded edge (4E) of the aperture (4).

Clearances of some millimetres (not shown) may be provided between the fuel lance (13) and the ring (15) in order to allow an easy assembly.

Each pre-tension block (19A; 21A) comprises a pre-tension surface (19S; 21S) arranged so as to contact the leg (15A, 15B) and to provide the pre-tension force (F) on the leg (15A, 15B) in order to block the ring (15) on the edge (4E) of the aperture (4). The manufacturing tolerances between the pre-tension surface (19S; 21S) and the tubular body (9A) are adjusted for this purpose.

The gap (P) is therefore formed between the pre-tension surface (19S; 21S) and the tubular body (9A).

The pre-tension force (F) acts in a substantial radial direction in respect to a hot gas path (G).

In another embodiment, a first intermediate element (19E, 21E) is located between the block (19A; 21B) and the leg (15A, 15B). The first intermediate element (19E, 21E) may be configured as a hook, a holder, a seal, or a coating.

Figure 5:
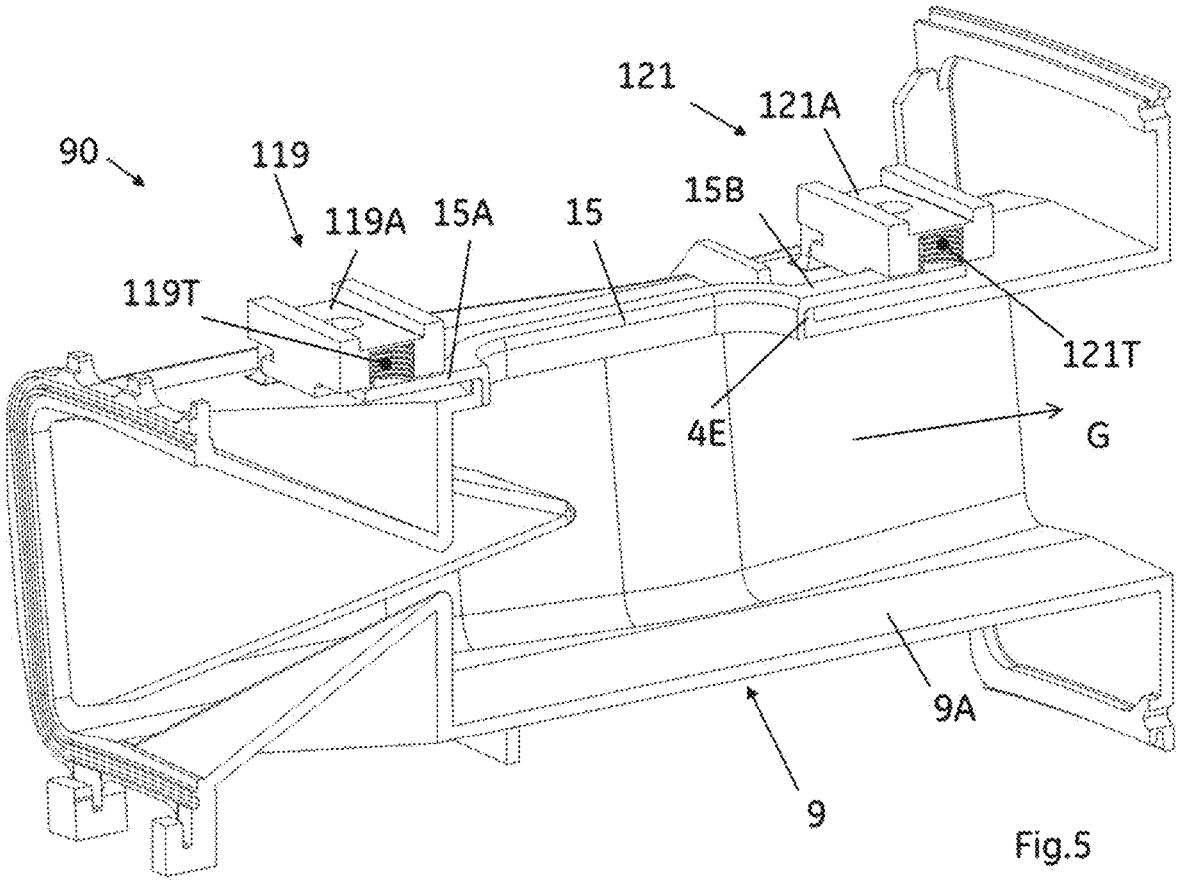
FIG. 5 shows a burner assembly according a second embodiment of the disclosure.

FIG. 5 shows a burner assembly (90) comprising a couple of pre-tension systems (119; 121) that each comprise a pre-tension block (119A; 121A) similar to the blocks (19A; 21A), with a pre-tension element (119T; 121T) placed in a respective block (119A; 121A).

These pre-tension elements (119T; 121T) are in the form of springs or bellows and configured to contact the respective leg (15A, 15B) in order to adjust the pre-tension force (F).

In this way, the manufacturing tolerances of the gap (P)—as described in reference to FIGS. 3 and 4—does not need to be adjusted.

Figure 6:
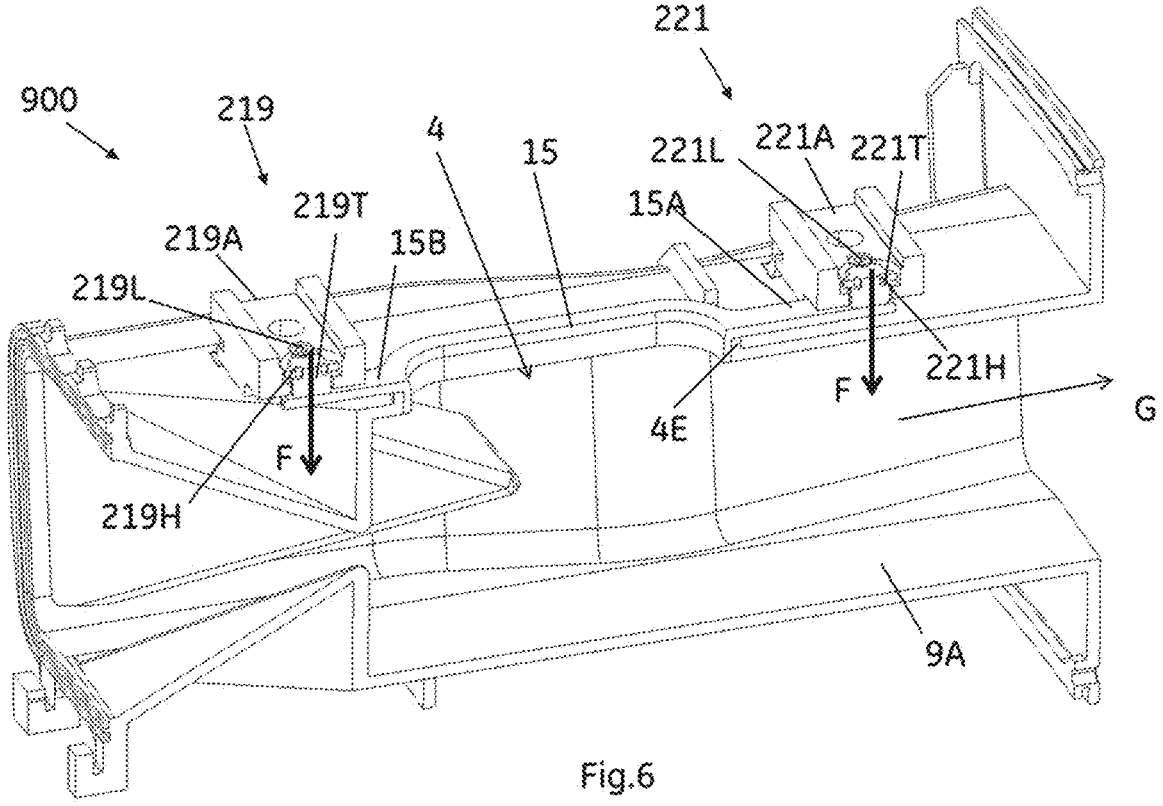
FIG. 6 shows a burner assembly according a third embodiment of the disclosure.

FIG. 6 shows a burner assembly (900) comprising a couple of pre-tension systems (219; 221), each of them further comprising a pre-tension block (219A; 221A) similar to the blocks (19A, 21A; 119A, 121A) of the previous embodiments, with the pre-tension element (119T; 121T) described in reference of FIG. 5 now made by a pre-tension bolt (219T; 221T) screwed on the respective block (219A; 221A).

Each of these pre-tension bolts (219T; 221T) is configured to contact the respective leg (15A, 15B) in order to adjust the pre-tension force (F).

In this embodiment, the manufacturing tolerances of the gap (P) do not need to be very accurate.

Figure 7:
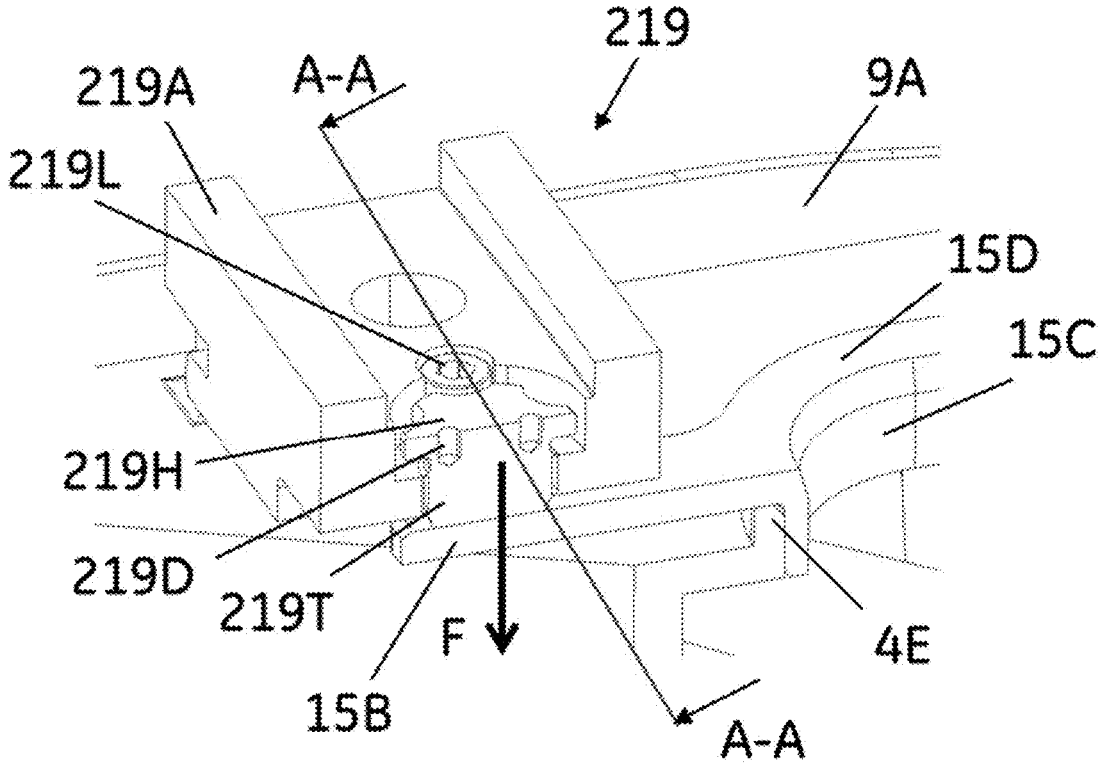
FIG. 7 shows an expanded view of a detail of FIG. 6.
Figure 8:
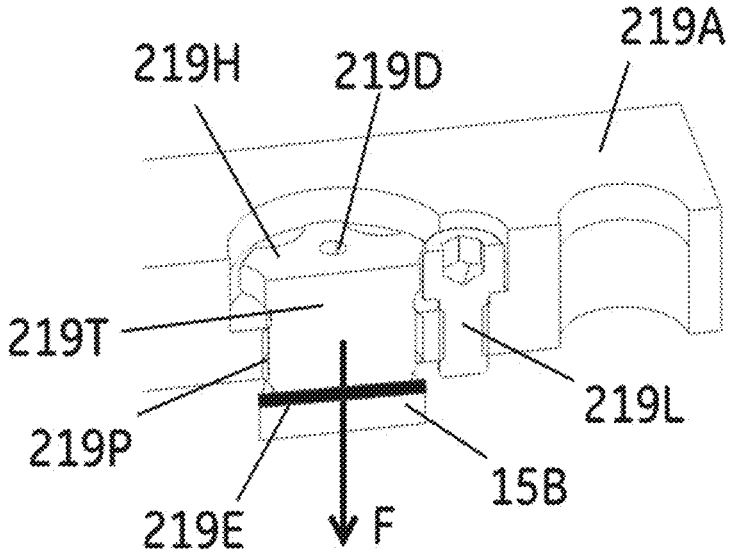
FIG. 8 shows a cross-section according A-A of FIG. 7.

In an embodiment of the invention, a locking element (219L; 221L) is screwed into each of the pre-tension blocks (219A; 221A) and the bolt (219T; 221T) comprises shaped heads (219H; 221H) able to engage with the respective locking element (219L; 221L), see also FIGS. 7 and 8.

The locking element (219L; 221L) can be a bolt, a pin, a bolt with inner hex head or similar structure.

The bolt (219T; 221T) is able to change its relative position in respect to the locking element (219L; 221L) with the counter-hole by turning, in order to allow adjustment of the pre-tension force (F).

FIG. 7 is a cross-section of the pre-tension block (219A) where it is possible to see, in particular, the bolt (219T) contacting and providing the pre-tension force (F) on the leg (15B) and, also, the protruded rim (15D) and the circular section (15C) contacting the edge (4E) of the aperture (4).

FIG. 8 is a section according A-A of FIG. 7 where it is possible to see, in particular, the shaped head (219H) engaging with the locking element (219L) screwed in the block (219A), in order to avoid the rotation of the bolt (219T) after installation or during operation; the bolt (219T) contacts and provides the pre-tension force (F) on the leg (15B).

In an embodiment, a second intermediate element (219E) is located between the bolt (219T; 221T) and the leg (15A, 15B), such as a wear resistant coating, a wear resistant shims, a pressure homogenizing joint such as a spherical joint or others.

FIG. 9 shows a view of the pre-tensioning bolt (219T) with a threated portion (219P) and the shaped head (219H) comprising screwing elements (219D), for example double-holes for a pin-wrench or additional hex head or inner hex-socket or similar, to easily allow the screwing of the bolt (219T) into the block (219A).

In an embodiment shown in FIG. 9, the shaped head (219H) comprises circular segments (219F) configured to match with the shape of the locking element (219L) in order to prevent the rotation of the bolt (219T).

FIG. 10 shows a top view of the assembly composed by the bolt (219T) and the locking element (219L) in a locking position (solid line) and in additional two possible locking positions (dotted lines) provided over a circumference by a defined pitch-ratio between the locking element (219L) and shaped head (219H) in order to reduce the incremental step size of the adjustment, thus increasing the possible adjustment precision and regulating the pre-tension force (F).

In FIG. 11, the pre-tension bolt (219T) is shown according other possible alternatives (319T; 419T; 519T; 619T).

According to another aspect a method for installing the fuel lance (13) in the burner assembly (9; 90; 900) comprising the following steps: provide a tubular body (9A) of the burner assembly (9; 90; 900) defining a hot gas flow path (G) during the turbine operation; provide an aperture (4) on the tubular body (9A) for positioning a Fuel lance (13) in the hot gas flow path (G); associate a wearing ring (15) of a sacrificial material to the edges (4E) of the aperture (4); said ring (15) comprising a leg (15A; 15B) extending along the tubular body (9A); associate a pre-tension system (19, 21; 119, 121; 219, 221) on the tubular body (9A); said system (19, 21; 119, 121; 219, 221) configured to contact said leg (15A, 15B) in order to provide a pre-tension force (F) on the ring (15); place the fuel lance (13) inside the aperture (4) so as to lie on the wearing ring (15).

According to an embodiment, the above mentioned step d) further comprises the following sub-step d1): providing a pre-tension block (19A, 21A; 119A, 221A; 219A, 221A) having a pre-tension surface (19S; 21S) arranged to contact the contacting leg (15A; 15B) in such a way to form a gap (P) with the tubular body (9A);

The sub-step d1) further comprises: adjusting the manufacturing tolerances between the pre-tension surface (19S; 21S) and the tubular body (9A) so as to contact and to provide the pre-tension force (F) on the leg (15A, 15B).

According to an alternative embodiment, the above sub-step d1) comprises: providing a pre-tension element (119T, 121T; 219T, 221T) in the pre-tension block (119A, 121A; 219A, 221A) configured to contact the leg (15A, 15B) in order to provide the pre-tension force (F).

This last sub-step may further comprise: providing a pre-tension bolt (219T; 221T) comprising a shaped head (219H; 221H) in the pre-tension block (219A; 221A) such as to provide the desired pre-tension force (F) on the legs (15A, 15B); screwing a locking element (219L; 221L) on the pre-tension block (219A; 221A) such as to engage with the shaped head (219H; 221H) to avoid any possible rotation of the pre-tension bolt (219T; 221T).

An additional step may include providing a plurality of locking positions of the locking element (219L; 221L) over a circumference around the shaped head (219H; 221H) in order to reduce the incremental step size of the adjustment, thus increasing the possible adjustment precision and regulating the pre-tension force (F).

While described in detail in connection with a sequential combustion gas turbine, embodiments may be applied to other types of gas turbine; the present invention being not limited to such sequential combustion gas turbine.

Additionally, only a limited number of embodiments have been described in the detailed description, it should be readily understood that the present description is not limited to such disclosed embodiments. Rather, the description can be modified to incorporate any number of variations, alterations, substitutions or equivalent arrangements not heretofore described. Additionally, while various embodiments have been described, it is to be understood that aspects may include only some of the described embodiments. Accordingly, the specification and claimed embodiments are not to be seen as limited by the foregoing description, but is only limited by the scope of the appended claims.

This written description uses examples to disclose the invention, including the preferred embodiments, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A burner assembly of a gas turbine comprising:

a tubular body defining a flow path for a hot gas of combustion during a turbine operation;

an aperture for a fuel lance, said aperture defined by an edge, said edge extending through a top surface of said tubular body and including a protruding portion extending transversely outward from said top surface of said tubular body;

a wearing ring fabricated from a sacrificial material, said wearing ring including i) a rim which rests on said protruded portion of said edge and ii) a section extending from said rim into said aperture and shaped to substantially correspond to said edge of said aperture;

at least one contacting leg extending from said rim along said tubular body; and a pre-tension system configured to contact said contacting leg to induce a pre-tension force on said ring against said tubular body;

wherein said at least one contacting leg comprises a first contacting leg and a second contacting leg, said first and second contacting legs extending in opposite directions outwardly from said rim along said tubular body, such that each first and second contacting legs are each substantially parallel to the hot gas flow path, said pre-tension system further configured to contact said first and second contacting legs.

2. The burner assembly according to claim 1, wherein said pre-tension system comprises a pre-tension block anchored to said tubular body such that a gap is defined between said pre-tension block and said tubular body, said gap is sized to receive said at least one contacting leg therein.

3. The burner assembly according to claim 2, wherein said pre-tension block comprises a pre-tension surface oriented to contact said at least one contacting leg to provide said pre-tension force.

4. The burner assembly according to claim 3, wherein a first intermediate element is between said pre-tension block and said at least one contacting leg.

5. The burner assembly according to claim 2, wherein said pre-tension block comprises a pre-tension component configured to contact said at least one contacting leg to provide said pre-tension force.

6. The burner assembly according to claim 5, wherein said pre-tension component is a pre-tension fastener coupled to said pre-tension block and wherein a locking element is coupled to said pre-tension block, a pre-tension fastener configured to engage with said locking element.

7. The burner assembly according to claim 1, wherein the wearing ring is formed integrally with said at least one contacting leg.

8. A method for installing a fuel lance in a burner assembly of a gas turbine, said method comprising:

forming a tubular body that at least partially defines a hot gas flow path within the turbine, wherein the tubular body includes an aperture defined by an edge, said edge extending through a top surface of said tubular body and including a protruding portion extending transversely outward from said top surface of said tubular body;

positioning a wearing ring, including a rim and a section extending from the rim, within the aperture, such that the rim of the wearing ring rests on said protruded portion of said edge and the section extends into the aperture to substantially correspond to the edge of said aperture, the wearing ring fabricated from a sacrificial material;

positioning a pre-tension system on the tubular body such that the pre-tension system contacts each of a pair of contacting legs extending in opposite directions from the rim of the wearing ring along the tubular body to induce a pre-tension force on the wearing ring, wherein the pair of contacting legs are oriented substantially parallel to the hot gas flow path, and inserting the fuel lance within the aperture such that the lance contacts the wearing ring and is positioned with the hot gas flow path.

9. The method according to claim 8, further comprising:

providing a pre-tension block including a surface oriented to contact the pair of contacting legs such that a gap is defined between the pre-tension block and the tubular body.

10. The method according to claim 9, further comprising:

adjusting the tolerances between the pre-tension surface and the tubular body such that the surface contacts the pair of contacting legs to induce the pre-tension force on the pair of contacting legs.

11. The method according to claim 9, further comprising:

providing a pre-tension element in the pre-tension block that is oriented to contact each respective contacting leg to enable selective adjustments of the pre-tension force.

12. The method according to claim 11, further comprising:

adjusting the pre-tension element, relative to the pre-tension block to provide the desired pre-tension force on the pair of contacting legs; and mounting a locking element into the pre-tension block to engage with the pre-tension element to prevent rotation.

* * * * *